US005707059A

United States Patent [19]

Sullivan et al.

[11] Patent Number: 5,707,059

[45] Date of Patent: Jan. 13, 1998

[54] PINBALL GAME HAVING NOVICE PLAY MODE

[75] Inventors: Dwight Sullivan; Kenneth Fedesna, both of Chicago, Ill.

[73] Assignee: Williams Electronics Games, Inc., Chicago, Ill.

[21] Appl. No.: 574,244

[22] Filed: Dec. 18, 1995

[51] Int. Cl.[6] ..... A63F 7/30

[52] U.S. Cl. ..... 273/121 A; 273/118 A; 273/119 A

[58] Field of Search ..... 273/118–121

[56] References Cited

U.S. PATENT DOCUMENTS

| | | | |
|---|---|---|---|
| 4,363,485 | 12/1982 | Edwall | 273/121 A |
| 4,650,190 | 3/1987 | Gieger | 273/121 A |
| 4,971,324 | 11/1990 | Grabel et al. | 273/119 A X |
| 5,149,094 | 9/1992 | Tastad | 273/121 A |
| 5,364,098 | 11/1994 | Kaminkow | 273/119 A X |

OTHER PUBLICATIONS

Premier Technology, Bensenville, IL, "Instruction Manual for Game Shaq Attaq", Oct. 1994, p. 15.

*Primary Examiner*—Raleigh W. Chiu

[57] ABSTRACT

A pinball game is provided with a control system which enables a game player to choose between a novice mode of play and a normal mode of play. In novice mode, game play proceeds for a predetermined time, regardless of the number of game balls played and selected game features, such as the tilt sensor, may be disabled. Game bonuses and free games may be made unavailable in novice mode to encourage experienced players to play in normal mode.

9 Claims, 4 Drawing Sheets

PINBALL GAME HAVING NOVICE PLAY MODE

BACKGROUND

The invention relates generally to amusement games and specifically to a system for providing a pinball player with a choice of playing a pinball game in a novice play mode or a normal mode of play.

As is well known, pinball games typically comprise an inclined playfield mounted in a game cabinet and supporting a rolling ball. Players control the game ball with flippers to score points by projecting the ball towards game features, such as targets, bumpers, and the like. Conventional pinball games provide the player with a predetermined number of game balls which are played on the game playfield. Each ball is projected onto the playfield and "drained" from the playfield when it rolls past the flippers or through bypass chutes. Game play proceeds until the predetermined number of game balls have been played and drained from the playfield.

Pinball games derive their appeal from the challenge they present to game players. Players are rewarded for skillful play with bonuses, extended game play, and free games. Usually, skillful play requires a significant investment of game time and expense before the new player becomes familiar with the particular scoring scheme and game features and develops the eye-hand coordination to control the ball and hit the desired targets. Game appeal thus depends on a player's willingness to learn the game. Often, a novice player with little skill and experience will quickly drain all of the game balls and experience an unexciting, short-lived game play. He or she may become intimidated and quickly lose interest in that particular pinball game or in pinball games in general. Thus, in order to permit players to develop their skills and maintain interest in a particular pinball game, it is desirable to provide new players with the option to learn and master a particular pinball game at a more reasonable cost. At the same time, the skilled player may become bored with a game that is "too" easy and doesn't provide enough challenge to keep him interested.

Known features address the problem of preventing the "quick drain" of game balls, but are not specifically concerned with permitting a player the choice between novice and normal modes of play. For example, in the instruction manual for the pinball game SHAQ ATTAQ, published in 1994 by Premier Technology of Bensenville, Ill., at page 15, "ball time safety" and "minimum game time" features are disclosed. Ball time safety returns the drained ball to the shooter if the ball drains before a predetermined time has expired for that ball. Minimum game time provides continued game play for an adjustable but predetermined minimum time selected by the game owner or operator (not the player) when the game is installed. Both features prevent the aforementioned "quick drain" problems of the prior art, but do not permit the player the option to choose between modes of play and to learn the game at his or her own pace while providing a challenging experience dependent upon the player's skill level.

Accordingly, it is a primary objective of the present invention to provide a pinball game which permits a game player to learn a particular pinball game become accustomed to the various play features at a reasonable cost, and provide a challenging play experience tailored to the players skill level.

It is another object of the invention to encourage the new player to learn the skills necessary for successful play of the game and to create an incentive for the new player to choose the normal play mode once he or she is comfortable with the new game.

SUMMARY OF THE INVENTION

The present invention accomplishes the aforementioned objectives by providing a pinball game which permits the player to select between a novice or normal mode of play. In the novice mode, game play continues for a minimum predetermined time, regardless of the number of game balls that are drained from the playfield. Novice mode may deactivate or increase the threshold required to activate certain game penalties, such as the tilt feature, in order to make the game more friendly to the novice. Novice mode may also deactivate game benefits, such as bonuses, free games for high scores, and free games by matching, in order to create an incentive for the experienced player to select the normal mode of play.

DETAILED DESCRIPTION OF A PREFERRED EMBODIMENT

Figure 1:
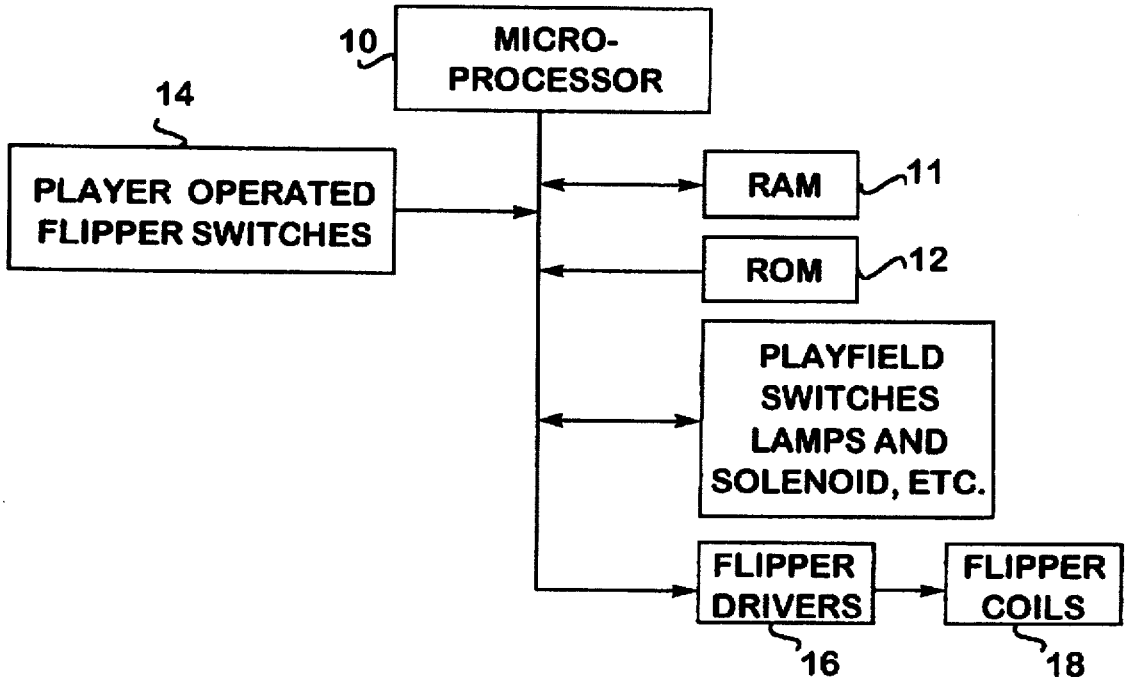
FIG. 1 is a block diagram representing a control system for a pinball machine suitable for use with the present invention.

Referring to FIG. 1, game processor 10 is interconnected by a bus in the usual manner to RAM memory 10 and ROM memory 12. In addition, the bus permits communication between the processor and the various playfield switches, solenoids, lights and displays.

As is known to those skilled in this art, the game processor typically controls the scoring and operation of the lights and displays of the pinball game as a function of the game software which is stored in the ROM memory 12. The game software responds to switch closures on the playfield causing the award of points, operation of lights and displays, actuation of playfield solenoids and similar devices. The RAM memory 14 is the processors working memory in which current game data is stored and manipulated. The processor also communicates with one or more player operated flipper switches 16, traditionally located on the sides of the pinball game cabinet. The processor 10, upon receiving a signal that one or both flipper switches have been closed will normally activate the appropriate flipper solenoid drivers (not shown).

Figure 2:
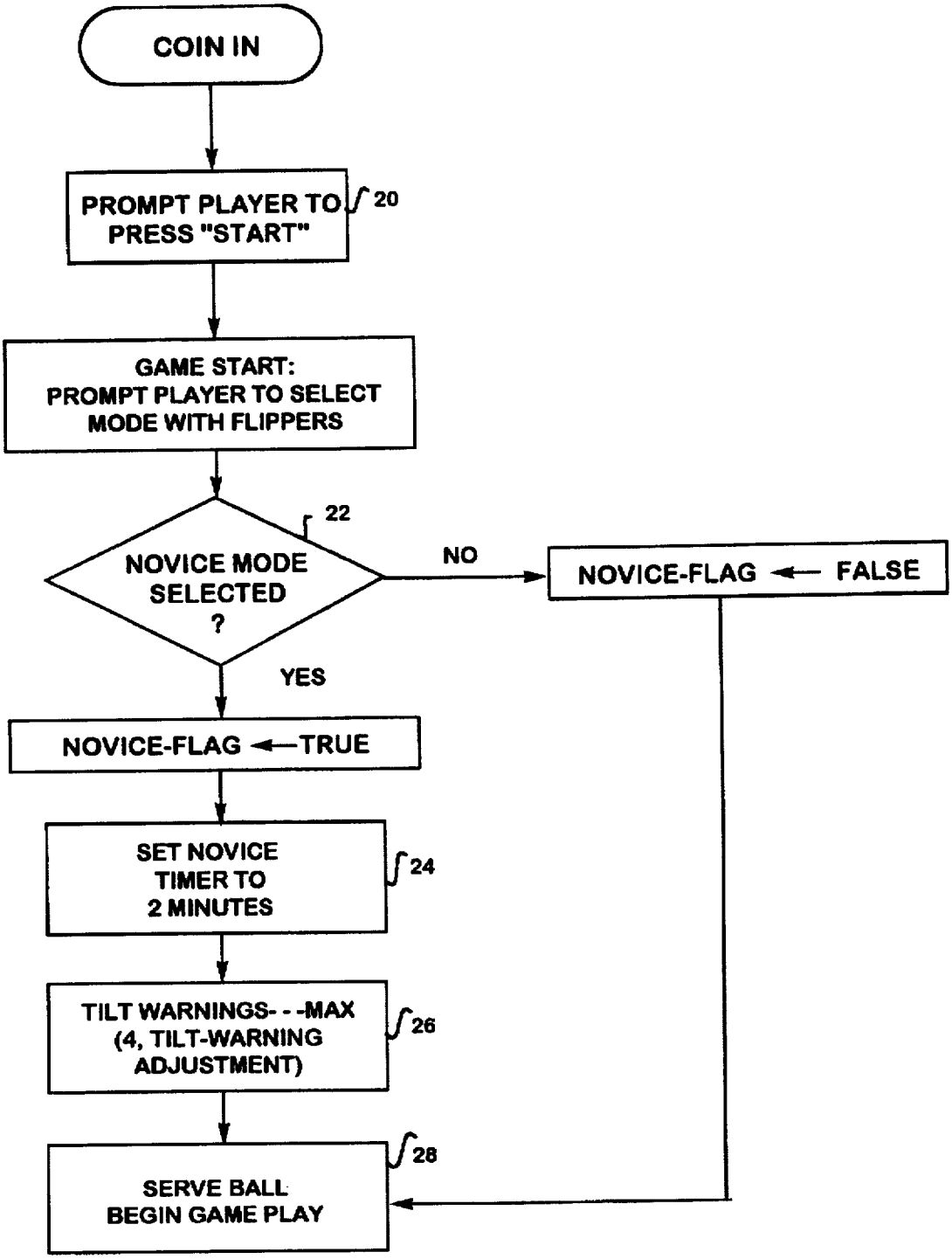
FIGS. 2–4 are flow diagrams indicating the operation of a preferred embodiment of the present invention.
Figure 3:
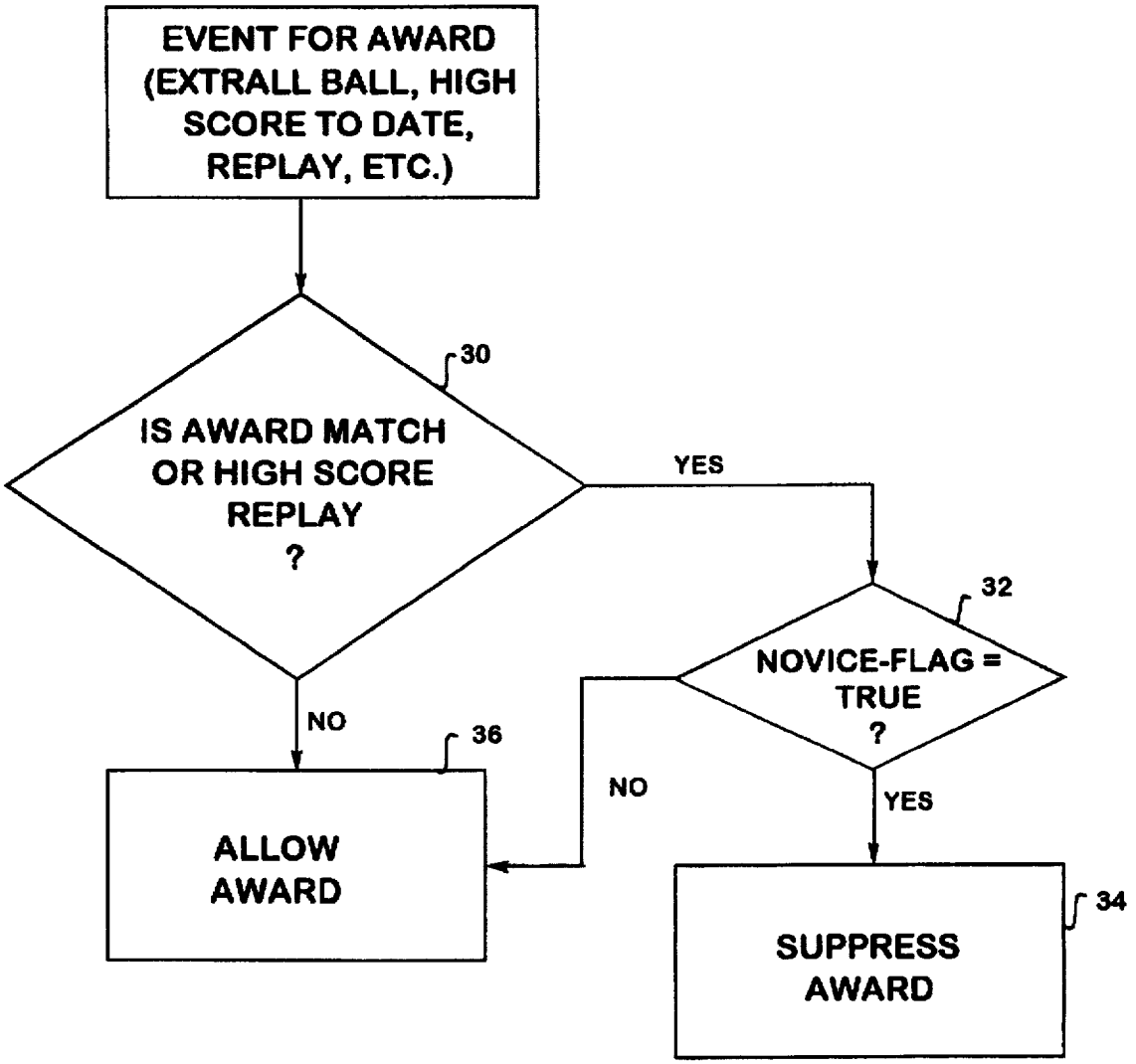
Figure 4:
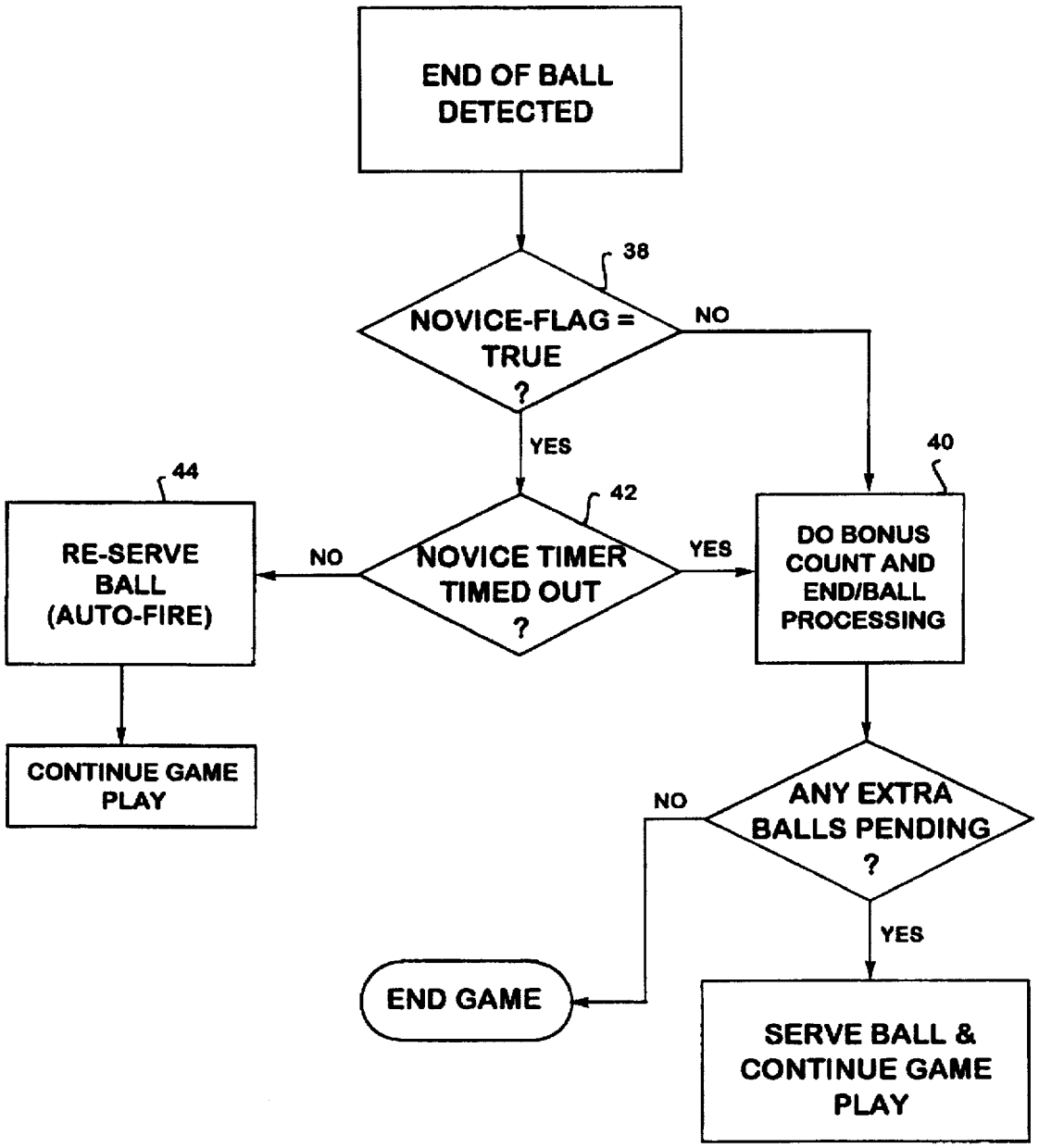

Referring to FIGS. 2–4, the software flow diagrams will be explained in sufficient detail to enable an ordinarily skilled programmer to implement the routines for practicing the invention in any desired computing language. Referring to FIG. 2, game play is initiated by a player depositing a coin into a receptacle on the machine and pressing a start button to initiate a series of game start-up routines. In accordance with the present invention, the player is prompted to select the mode of play for the upcoming game as represented by box 20. Prompting preferably occurs with an LED display array mounted on the back box of the game cabinet. In the preferred embodiment, players select one of the modes of play by activating one of the two flipper buttons according to instructions on the display.

A routine is invoked to determine whether novice mode has been selected by the player as represented by decision box 22. Typically, the routine will involve a loop which checks for actuation of one of the flipper buttons. When novice mode is selected, a series of initial commands are executed by processor 10 and game control occurs as a function of novice mode play instructions stored in memory. First, an internal flag NOVICE-FLAG is set to the "TRUE" position and game control occurs as a function of novice mode instructions stored in memory. A timer is set to a value (illustrated as two minutes) corresponding to the novice mode play duration as represented by box 24.

As an additional aid to the novice player, the tilt threshold may be adjusted, as illustrated at 28, when the novice mode is selected. In conventional pinball games a player is penalized for moving the game cabinet to influence the motion of the game ball. Typically, a motion switch is provided to sense significant movement of the game cabinet and, if closed, will disable the flipper controls and game features until the current ball drains from the playfield. In normal mode, the tilt threshold is set to one: a single closure of the motion detecting switch will disable the game features. In accordance with the present invention, the number of tilt warnings may be increased in the novice mode of play so that more than one closure of the motion detecting switch is require before the game features are disabled. The game instructions may provide a visual or audible warning for each switch closure so that the new player becomes familiar with the amount of movement that the game will tolerate before the player experiences an actual "tilt" condition. The initialization routine for novice mode play terminates with service of the game ball onto the playfield and beginning of game play as represented at 28.

In the novice play mode, game play will continue until the predetermined time has passed, regardless of the number of game balls played. Referring to FIG. 4, at each "end of ball condition" signaled by a sensor disposed to detect when a ball has drained from the playfield, the setting of the NOVICE-FLAG is checked at 38. For a FALSE condition, the ordinary routine for ending ball play is executed as represented by 40. If the NOVICE-FLAG is set to TRUE, however, the novice timer is checked for expiration at 42. If the novice timer has not expired, a new ball is projected onto the playfield as represented by 44 and game play continues. If the novice timer has expired, the processor is instructed to determine if any extra balls are pending, step 46. Extra balls may be pending, for example, if the player has won an award by hitting designated targets and thus has balls remaining to be played after the novice timer has expired. If extra balls are not pending, the game is ended as represented by 48. If extra balls are pending, the next ball is fired onto the playfield and game play continues until the player has drained the extra game ball(s).

As an incentive for experienced players to choose the normal mode of play, various game functions, awards, or features may be selectively disabled during novice mode play. For example, the match feature and high score replay awards typical of conventional pinball games may be deactivated. Referring to FIG. 3, the processor is instructed to determine whether the condition for such an award has occurred, as represented by decision box 30. If the conditions are met, the processor then determines the status of NOVICE-FLAG at 32. If the NOVICE -FLAG is TRUE, then the award is disabled step 34. If, on the other hand, NOVICE-FLAG is FALSE, or a different award is involved then the award is allowed as represented at 36. Those of ordinary skill will recognize that the above scheme is adaptable to various game awards, features, and functions.

The present invention has been described with respect to certain embodiments and conditions, which are not meant to and should not be construed to limit the scope of the invention. Those skilled in the art will understand that variations may be made without departing from the spirit and scope of the invention defined in the claims which follow.

What is claimed is:

1. A pinball game comprising a) an inclined playfield having a plurality of game features and supporting a rolling game ball thereon, b) processor means for controlling the function of said game including means for permitting game play in one of two player selectable modes:

(i) normal mode wherein the duration of game play is determined as a function of the number of balls played;

(ii) novice mode wherein the duration of game play is determined as a function of time;

c) player operated switch means for permitting the player selection of the mode of play at the beginning of each game.

2. The pinball game of claim 1, said processor means further including means for disabling at least one game function during the novice mode of play.

3. The pinball game of claim 1, wherein said player-operated switch means also activate flipper elements.

4. The pinball game of claim 1, wherein said processor means alters at least one game function responsive to the mode selected.

5. The pinball game of claim 4, wherein the game function is a game replay feature.

6. The pinball game of claim 4, wherein the game function is a tilt penalty feature.

7. The pinball game of claim 1, wherein said processor means disables at least one game function when said novice mode is selected.

8. The pinball game of claim 7, wherein said game function is a game replay feature.

9. The pinball game of claim 7, wherein said game function is a tilt penalty feature.

* * * * *